United States Patent [19]

Koch et al.

[11] Patent Number: 4,843,669

[45] Date of Patent: Jul. 4, 1989

[54] METHOD FOR WET PROCESSING OF TUBULAR TEXTILE MATERIAL

[75] Inventors: Werner Koch, Wald-Michelbach; Manfred Schuierer, Michelstadt, both of Fed. Rep. of Germany

[73] Assignee: Bruckner Apparatebau GmbH, Fed. Rep. of Germany

[21] Appl. No.: 107,245

[22] Filed: Oct. 9, 1987

[30] Foreign Application Priority Data

Oct. 16, 1986 [DE] Fed. Rep. of Germany ..... 3635289

[51] Int. Cl.[4] ..... D06B 23/08

[52] U.S. Cl. ..... 8/151; 26/74; 26/80; 57/1 UN; 68/13 R; 68/22 R

[58] Field of Search ..... 8/151; 68/13 R, 22 R; 57/1 UN; 26/74, 80

[56] References Cited

U.S. PATENT DOCUMENTS

| | | | |
|---|---|---|---|
| 2,759,324 | 8/1956 | Dean | 57/1 UN |
| 4,166,367 | 9/1979 | Sando et al. | 68/22 R X |
| 4,285,694 | 8/1981 | Itoh et al. | 8/151 X |
| 4,329,838 | 5/1982 | Zerle et al. | 57/1 UN |

FOREIGN PATENT DOCUMENTS

| | | | |
|---|---|---|---|
| 3135452 | 3/1983 | Fed. Rep. of Germany | 57/1 UN |
| 38339 | 10/1978 | Japan | 57/1 UN |
| 15581 | 1/1984 | Japan | 8/151 |

*Primary Examiner*—Philip R. Coe
*Attorney, Agent, or Firm*—Sheldon & Mak

[57] ABSTRACT

The invention relates to the wet processing in particular of knitted tubular material in the broad tubular state which in a first processing section is led through a fluid bath then inflated to form a balloon section and afterwards led in the broad tubular state through the gap between a pair of squeezer rollers. Within the fluid bath the incoming material in hank form is subjected to twist sensing and if any twist is detected the incoming tubular material is rotated in the region before the first processing section to undo the twist. The completely and stably relaxed and untwisted tubular material leaves this first processing section in a stable broad tubular state and can then be passed in an optimum manner through the succeeding principal processing sections.

7 Claims, 3 Drawing Sheets

METHOD FOR WET PROCESSING OF TUBULAR TEXTILE MATERIAL

The invention relates generally to a method of wet processing tubular textile material, particularly knitted tubular material. More specifically, the invention relates to a method of wet processing tubular textile material wherein the tubular material is treated in a first processing section by being passed through a fluid bath, being inflated into a balloon section by having a gas blown into it, and being passed through the gap between a pair of squeezer rollers.

Wet processing methods and apparatus of the aforesaid type are known in the art in very varied constructions. One such construction is described for example in German Offenlegungsschrift No. 28 13 603. This relates to the mercerising of tubular textile materials, and in particular to the uniform impregnation of the tubular material at uniform tension. The tubular material is laid flat and guided in a zig-zag fashion to an impregnating fluid bath, whereupon it is inflated like a balloon by blowing air into it before it passes through a pair of squeezer rollers. In this known construction a plurality of such processing sections of similar construction are connected one after the other for the purpose of impregnation and alkali treatment.

In recent years the quality requirements for light knitted goods have risen dramatically, with the consequence that efforts have increasingly been made to use particularly gentle processes on these materials which have a tendency to crease. This can be done particularly effectively in the broad tubular state of the tubular material.

One tubular material which is particularly difficult to process is known by the term "single jersey". After it has been knitted, this material lies completely straight (with the warp threads straight). At the moment in which the tubular material is wetted—in a first wet processing stage—and swells, tensions contained in the knit and the twist (torsion within the tubular material) are released. The degree of twist depends upon the model of knitting machine used, the spacing and in particular the twisting of the yarn. Since each wet processing stage ends with a water-removing arrangement, and this only works satisfactorily when the mateial is guided in the broad tubular state, provision must be made in the first wet processing stage for undoing the twist and releasing the tension in the tubular material.

For example, in a circular-knit tubular material the spiral twist in the material in the dry state can be partially compensated for by using widthways laying machines to untwist the tubular material, release the tension in it and lay it out in the broad tubular state. However, with its first contact with fluid and further release of tension the tubular material is frequently also subjected to torsion.

Attempts have been made in the art to solve this problem in various ways. In many cases this was achieved by mechanical stretchers at the inlet of a wet processing apparatus and optionally with a rotary device connected before it which untwists the entire stock of material in the appropriate direction. However, the tubular material has to be guided in such a way that there are no resting or storage zones inside the apparatus since then the tubular material would again be correspondingly relieved of tension and would twist.

The object of the invention therefore is to provide a method of wet processing tubular textile material by means of which even relatively light knitted tubular materials and tubular materials which run in with any degree of twist can be wet processed in the broad tubular state.

This object is achieved according to the invention.

In this method according to the invention the tubular material running in is first of all brought quite intentionally into hank form. Therefore tubular material can arrive in a quite disordered state, it is not subjected to any mechanical deformation (such as, for example, by means of squeezer rollers) as it runs into the first processing section and thus can run in in hank form without any problem. This hank form of the tubular material also favours the sensing of the spiral or screw thread-shaped twist in the tubular material, and this sensing is advantageously carried out inside the solution bath in the first processing section.

When in the course of this twist sensing a twist or torsion of the tubular material in one or the other direction is detected, then the tubular material is turned in the region before the first processing section in an appropriate manner so that the detected twist can be largely undone at this stage. If no twist in the incoming tubular material is detected inside the solution bath then the tubular material does not need to be turned in the region before the first processing section.

The tubular material which runs in in this monitored and controlled fashion can then be inflated as it travels further to form a sort of balloon section, which releases the tension in it so that it can be passed smoothly and free of creases through the gap between the squeezer rollers. The tubular material which has thus been relieved of tension and squeezed out can then rest in an advantageous manner in the broad tubular state in an adjoining storage zone, and the preceding method steps ensure that during this rest or interim storage the tubular material remains free of torsion in the relaxed state. In this way ideal preconditions are created for a subsequent further wet processing which can be carried out in any suitable manner, preferably continuously. This wet processing can be continuous dyeing, washing, bleaching or another finishing process.

If necessary, after the tubular material has passed continuously through the first processing section it can also be further processed intermittently in the broad tubular state.

This method according to the invention also permits particularly gentle processing of light knitted materials, such as for example "single jersey", during which the interim storage of the relaxed and untwisted tubular material without problems and for any length of time in the broad tubular state is noticeable as extremely advantageous.

Further embodiments of the invention are the subject matter of the other subordinate claims.

The invention will now be explained below in greater detail with the aid of the drawings.

The drawings have been kept largely schematic, and in them:

Figure 1:
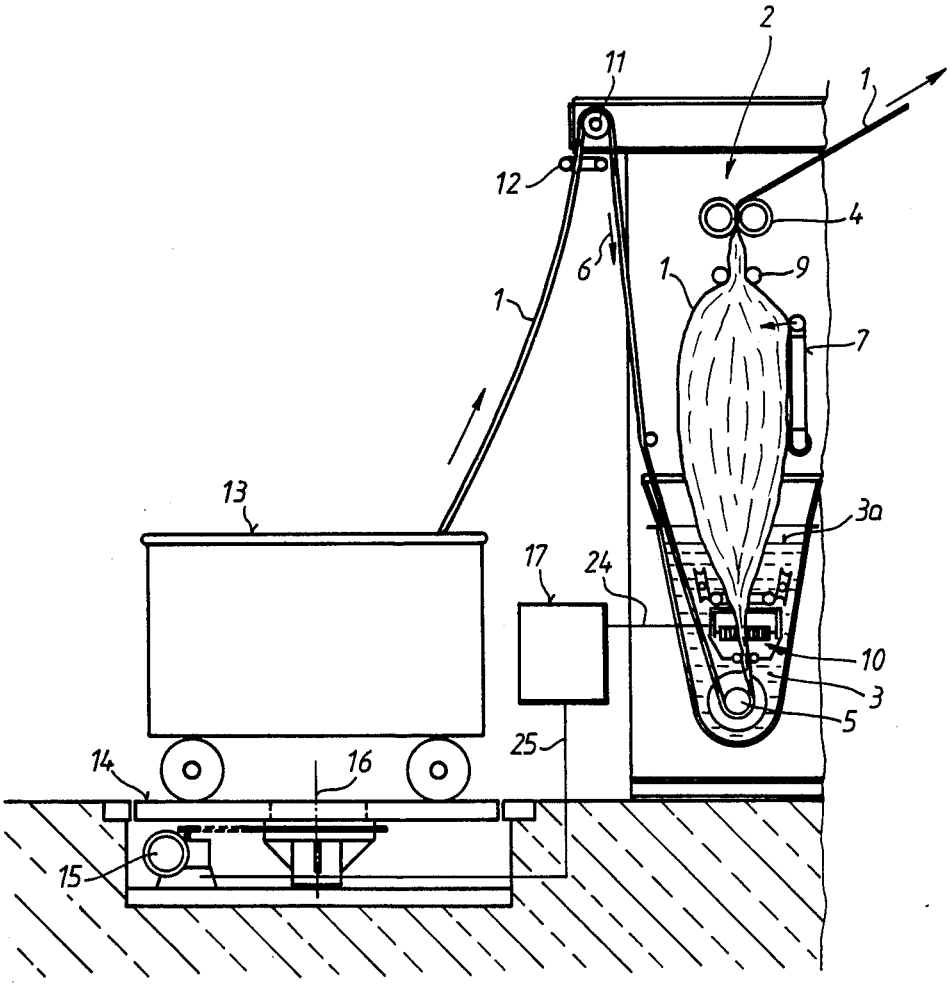
FIG. 1 shows a simplified longitudinal sectional view through the inlet section of the wet processing apparatus.

First of all the inlet section of a wet processing apparatus will be explained in essence with the aid of FIG. 1. An inlet section 2 is provided here as a first wet processing section for a tubular textile material to be processed, in particular circular-knit tubular material 1. This inlet section 2 is aligned substantially vertically and contains a fluid bath 3 at its lower end and at its upper end it has a squeezer arrangement constructed for example in the form of a pair of squeezer rollers 4 with a gap between them for the tubular material 1 to pass through in the broad tubular state. At the bottom of the fluid bath 3 there is a guiding arrangement which is formed in this case for example by a guide roller 5 by means of which the tubular material 1 arriving in the direction of the arrow 6 is guided approximately upwards. In the region between the fluid bath 3 and the pair of squeezer rollers 4 an arrangement 7 for blowing in air is provided, by means of which air (or another suitable gas) is blown in a manner which is known per se onto the upwardly moving tubular material 1 in such a way that an air bubble or balloon section 8 is formed with its upper end defined by the pair of squeezer rollers 4 and optionally by an additional pair of guiding rollers 9, its lower end reaching into the fluid bath 3.

In the region between the level 3*a* of the fluid bath and the guide roller 5 a twist sensing arrangement 10 is provided inside the fluid bath 3 through which the tubular material 1 which is assembled in hank form passes and which will be explained in greater detail below.

In the intake part of the inlet section 2 a ring 12 is arranged below an upper guide roller 11. This ring can for example be a fine steel tubular ring and can be constructed with its internal diameter and arranged in such a way that the tubular material 1 delivered in any state in a wagon 13 or the like runs through this ring 12 and is thus brought into a tubular form so that the tubular material 1 runs in hank form at least as far as the region of the fluid bath 3 in which the twist sensing arrangement 10 is located, so that the tubular material 1 in hank form can be subjected to sensing for twist. Above this twist sensing arrangement 10 is located the lower end of the balloon section 8, which is relatively unstable.

If necessary the ring 12 (optionally with the guide roller arranged above it) can be moved to and fro in the transverse direction of the inlet section 2 in order to assist and favour optimum feeding and filling of narrow tubular material into the fluid bath 3 or any store connected before it.

A rotating platform 14 which holds a stock of tubular material 1 (in the wagon 13) is arranged in advance of the inlet section 2 before the ring 12 which serves to form the hank. This rotating platform 14 can be rotated about a vertical axis with the aid of a drive means 15. In this way the stock of tubular material 1 in the wagon 13 can be turned in one or the other direction of rotation to undo its twist.

This rotating platform 14, particularly its drive 15, is connected for control purposes to the twist sensing arrangement 17 in such a way that as a function of the result obtained by the twist sensing arrangement 10 it can be driven to rotate to the left or to the right or—if no twist is detected in the hank of tubular material 1—brought to a halt or kept immobile.

Figure 2:
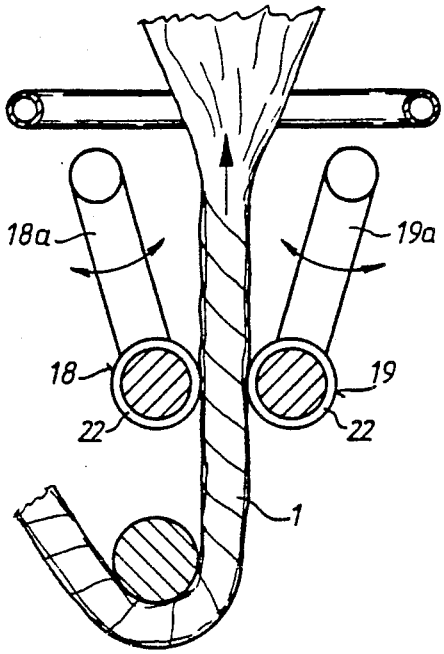
FIG. 2 shows an enlarged view of a detail in the region of a twist sensing arrangement.
Figure 3:
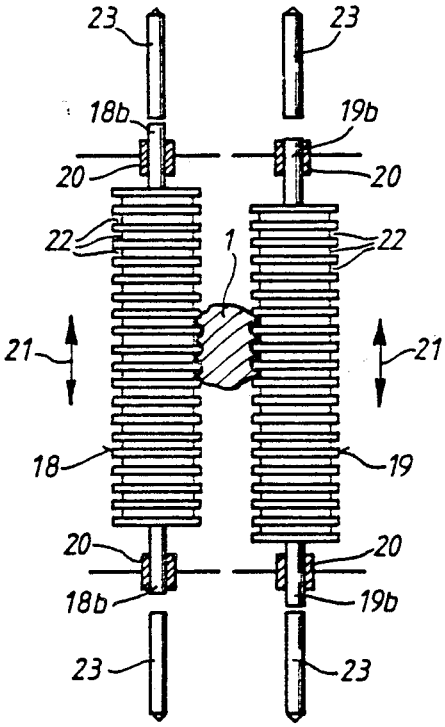
FIG. 3 shows a plan view of a pair of rollers of the twist sensing arrangement according to FIG. 2.

The twist sensing arrangement 10 will now be dealt with in greater detail with the aid of FIGS. 1, 2 and 3.

This twist sensing arrngement 10 contains two sensing rollers 18, 19 which are arranged parallel to one another with their circumferences a certain distance apart corresponding approximately to the thickness of the hank of tubular material 1. The two sensing rollers 18, 19 are of substantially similar construction, are mounted in bearings 20 and are freely axially movable in the direction of the double arrows 21. In addition these two sensing rollers 18, 19 are provided on their circumferences with a plurality of annular grooves 22, and at least the grooved circumferential surfaces of these sensing rollers 18, 19 can be made from plastics material. The two sensing rollers 18, 19 can be retained so as to be freely rotatable on pivot levers 18*a* and 19*a* respectively (FIG. 2) in such a way that the distance between their circumferences can be adjusted and adapted to the thickness of the hank of tubular material so that the tubular material 1 in hank form runs between these two sensing rollers 18, 19 in contact with the circumferences thereof.

As indicated in FIG. 3, the axle ends 18*b* and 19*b* respectively of the sensing rollers 18, 19 are associated with approach initiators 23 by means of which any axial movement of each sensing roller 18, 19 in one or the other direction is detected. Such axial movement indicates whether or not there is any twist in the hank of tubular material 1, and the direction of movement, i.e. opposite movement of the two sensing rollers 18, 19 with respect to one another indicates the presence of a twist in the tubular material as well as the corresponding direction of the twist. A corresponding signal is then sent by means of these approach initiators 23 via a line 24 to the control arrangement 17. From this control arrangement 17 a control line 25 leads to the drive means 15 for the rotating platform 14, so that this rotating platform drive means then—as a function of the result of the twist sensing in the arrangement 10—receives a corresponding signal, namely whether the rotating platform 14 should be rotated to the left or to the right or brought to a halt or not rotated at all.

With the aid of the inlet section of the wet processing apparatus described above, tubular material 1 can advantageously be delivered in its row state (that is to say without prior widthways laying or special operations) from the stock wagon 13 via the ring 12. The incoming tubular material 1 passes through the ring 12 and is brought into hank form in which it runs over the guide roller 5 into the fluid bath 3 and there passes through the twist sensing arrangement 10. When the presence of a twist in the tubular mterial 1 is detected by the twist sensing arrangement in the manner described above, the rotating platform 14 with the wagon store is rotated by means of the control arrangement 17 and the drive means 15 in order to undo the twist. The tubular material 1 runs on upwards and is then inflated with the aid of the air blowing arrangement 7 to form a balloon section 8 and thereby relaxed. The wetting or impregnation of the tubular material 1 with solution and the inflation of the tubular material 1 then lead to such thorough relaxation of the tubular material that at the end of the balloon section 8 it can be led into the pair of squeezer rollers 4 in the broad tubular state and stably relaxed. This is a prerequisite for interim storage or resting of the tubular material 1 immediately thereafter in a storage zone with any storage sections.

The inlet section can be associated with any suitable continuous wet processing apparatus which is constructed for tubular material in the broad tubular state and in which—as already indicated—a material store with at least one storage section for accommodation and interim storage of the tubular material 1 in the broad tubular state coming from the pair of squeezer rollers 4 is arranged after this inlet section 2.

Figure 4:
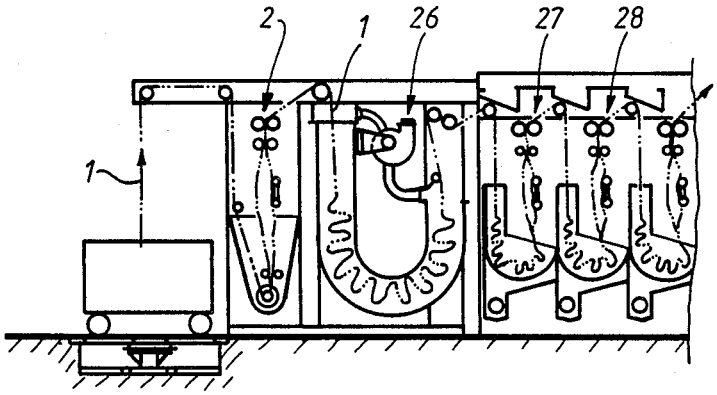
FIG. 4 shows a further simplified schematic view of a wet processing apparatus with an inlet section as described with the aid of FIG. 1.

FIG. 4 shows an example of such continuous wet processing apparatus in a greatly simplified schematic representation. In this FIG. 4 an inlet section 2 is provided in the inlet portion of the wet processing apparatus and in its construction and its function corresponds exactly to what has been described above with the aid of FIGS. 1 to 3. In this case it may be assumed that after running through the inlet section 2 the tubular material 1 in the broad tubular state runs into a material store which is constructed in the form of a resting boot 26. After this the tubular material 1 in a satisfactorily broad tubular state can run continuously in a suitable manner through further sections, of which only some boot-shaped sections 27, 28 are indicated.

Figure 5:
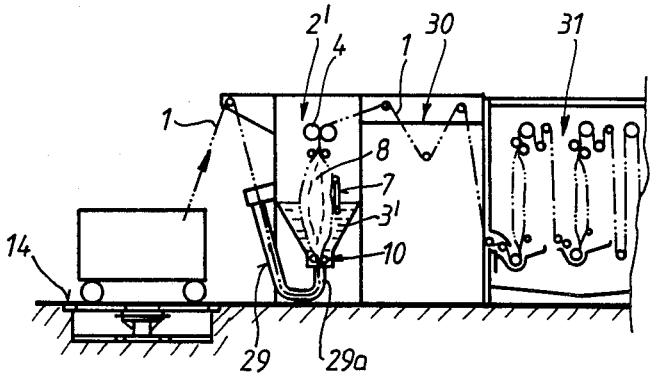
FIG. 5 shows another schematic view of a wet processing apparatus with a somewhat different inlet section.

In the construction of the wet processing apparatus according to FIG. 5 it may be assumed that an inlet section 2' broadly similar to that of FIGS. 1 to 3 is arranged in the inlet portion as the first processing section. However, in contrast to the first embodiment, it may be assumed here that the hank-forming arrangement is not in the form of a ring but in the form of a bent, preferably U-shaped pipe 29 which serves for delivery of the tubular material, has its outlet end **29*a* directed upwards and opening into the fluid bath 3' and in this case at the same time forms the guiding arrangement for the tubular material 1 at the lower end of the fluid bath 3'. The twist sensing arrangement 10 can be constructed in the same way as in the preceding embodiment, and the same applies to the air blowing arrangement 7, the squeezing arrangement (pair of squeezer rollers 4) which defines the balloon section 8 at the upper end and the rotating platform 14**.

In this embodiment according to FIG. 5 it may be assumed that the inlet section 2' in the inlet portion is arranged as a continuous dyeing machine. The tubular material 1 coming in the broad tubular state first of all passes into a sort of interim material store (roller store) 30 before it passes into conventional dye application sections 31 followed by fixing sections, washing sections and the like (as known per se) so that this tubular material can be continuously and successively dyed, fixed, rinsed, oxidised, washed and freed of water.

With regard to the use of the delivery pipe 29 for the tubular material before the inlet to the fluid bath 3' it should also be mentioned that because of this and also because of the funnel-shaped construction of the lower end of the inlet section 2' the apparatus can be operated with very little fluid.

It goes without saying that the method according to the invention and the apparatus according to the invention can be adapted in an optimum manner to any type of subsequent processing which might be called for, and in any case even relatively light circular-knit tubular material and similar materials with a tendency to crease can be processed extremely gently and—in the essential wet processing sections—in the broad tubular state, since the incoming tubular material in the inlet section 2 or 2' can already be reliably and stably relaxed and freed of twisting.

We claim:

1. A method of wet processing tubular textile material in the broad tubular state comprising the steps of:

(a) wetting the material in a fluid bath located in a first processing section;

(b) sensing any twists in the material after the material has been wetted inthe fluid bath by means of a sensing apparatus;

(c) rotating the material upstream of the fluid bath to relieve any twisting sensed in the material by the sensing apparatus, the amount of rotation being controlled in proportion to the degree of twisting sensed by the sensing apparatus; and (d) further processing the textile material after the step of sensing any twist in the material by (i) blowing gas into the material downstream of the fluid bath to form a ballon section for inflating the material into a broad tubular state;

(ii) passing the material after it has had gas blown into it through a gap between a pair of squeeze rollers; and (iii) storing the material in a storage zone after it has been passed between the squeezer rollers.

2. Method as claimed in claim 1, characterised in that the tubular material runs continuously through the first processing section and is then subjected in the broad tubular state to continuous further wet processing.

3. Method as claimed in claim 1, characterised in that the tubular material runs continuously through the first processing section and is then subjected in the broad tubular state to discontinuous further wet processing.

4. Method as claimed in claim 1, in which the balloon section of the tubular material runs substantially vertically upwards through the first processing section, characterised in that the upper end of the ballon section is defined by the gap between the squeezer rollers, whilst the lower end extends in an unstable manner into the fluid bath and here the twist in the tubular material in hank form is sensed.

5. The method as claimed in claim 1 wherein the material is a knitted material.

6. The method as claimed in claim 5 wherein the material is a single jersey material.

7. The method as claimed in claim 5 wherein the material is a circular-knit tubular material.

* * * * *